US005268251A

United States Patent [19]

Sakuma

[11] Patent Number: 5,268,251

[45] Date of Patent: Dec. 7, 1993

[54] LIGHT-SENSITIVE SILVER HALIDE PHOTOGRAPHIC MATERIAL IMAGE QUALITY- AND GRADATION-ADAPTABLE TO PHOTOGRAPHING PURPOSES AND IMAGE FORMING METHOD THEREFOR

[75] Inventor: Haruhiko Sakuma, Hino, Japan

[73] Assignee: Konica Corporation, Tokyo, Japan

[21] Appl. No.: 901,237

[22] Filed: Jun. 19, 1992

[30] Foreign Application Priority Data

Jun. 26, 1991 [JP] Japan ..... 3-154715

[51] Int. Cl.[5] ..... G03C 5/16

[52] U.S. Cl. ..... 430/139; 430/567; 430/966; 430/502; 430/508; 430/509

[58] Field of Search ..... 430/139, 567, 966, 502, 430/508, 509

[56] References Cited

U.S. PATENT DOCUMENTS

| | | | |
|---|---|---|---|
| 4,801,526 | 1/1989 | Yoshida et al. | 430/567 |
| 4,994,355 | 2/1991 | Dickerson et al. | 430/509 |
| 4,997,750 | 5/1991 | Dickerson et al. | 430/509 |
| 5,021,327 | 6/1991 | Bunch et al. | 430/502 |
| 5,108,881 | 4/1992 | Dickerson et al. | 430/502 |

FOREIGN PATENT DOCUMENTS

| | | | |
|---|---|---|---|
| 0437117 | 1/1990 | European Pat. Off. . | |
| 0384633 | 8/1990 | European Pat. Off. | 430/509 |
| 0440367 | 8/1991 | European Pat. Off. . | |

*Primary Examiner*—Charles L. Bowers, Jr.
*Assistant Examiner*—Thomas R. Neville
*Attorney, Agent, or Firm*—Frishauf, Holtz, Goodman & Woodward

[57] ABSTRACT

A light sensitive silver halide photographic material for the use of X-ray photography, wherein the effective contrast characteristics of the photographic material can be changed as required for the type image being exposed, as a function of the number and disposition of fluorescent intensifying screens. The photographic material has a support carrying first and second emulsion layers on each side thereof. The first layer has a maximum density and sensitivity higher than that of the second layer; the second layer has a density of not more than 0.2 when exposed from the side of the first layer with sufficient irradiation to give the first layer a density of 1.0; and the slope connecting two points corresponding to densities of 0.8 and 1.3 above the fog or baseline on a characteristic curve of the first layer is more than the slope of a line connecting two points of 0.3 and 0.5 above the fog or baseline on a characteristic curve of the second layer.

10 Claims, No Drawings

LIGHT-SENSITIVE SILVER HALIDE PHOTOGRAPHIC MATERIAL IMAGE QUALITY- AND GRADATION-ADAPTABLE TO PHOTOGRAPHING PURPOSES AND IMAGE FORMING METHOD THEREFOR

FIELD OF THE INVENTION

The present invention relates to an X-ray lightsensitive silver halide photographic material (X-ray films) capable of exhibiting density and latitude characteristics adapted to development image requirements. This permits using a single type of film for a wide range of purposes.

BACKGROUND OF THE INVENTION

X-ray films are at present commercially available in a number of types according to image characteristic of the portions or the body to be photographed (or X-rayed) or the photographing purposes. For example, in the case of KONICA CORPORATION, products are already on the market in a number of types such as SR-G for general purpose, SR-V for high-speed purpose as in contrast photographing, SR-H or SR-HG for high-contrast photographing, SR-L for low-contrast photographing as in the photographing of the digestive organs, SR-C for wide-latitude photographing for the photographing of the chest, and also new-CM for the photographing of portions for which an ultra-high sharpness is needed as in the photographing of the breast.

Thus, a number of film types are made for use depending on the individual photographing purposes. This not only makes the stock management by users very cumbersome but also provides a possibility of mistaking film types when used. When the wrong film type is used, the result can be serious difficulty in diagnosis.

From the standpoint of film manufacturers and dealers, it is not preferable to manufacture and sell so many types of films, because of an increase in cost and a difficulty that may be caused in distribution of goods. Thus, improvements therefor have been earnestly sought.

The terms used to define the invention to have their conventional means. The term "fog" as used herein means the density of photographic material after development, measured through a portion of photographic material displaying minimum density. In negative X-ray image, this means the density at unexposed area. In positive X-ray image, this means the density at fully exposed area. The term "characteristic curve" refer to a plot of a density measured on a developed photographic light sensitive material versus exposure.

SUMMARY OF THE INVENTION

A first object of the present invention is to provide a single type of X-ray light-sensitive silver halide photographic material capable of exhibiting characteristics which can be adapted or altered to a variety of photographing purposes.

A second object of the present invention is to provide an X-ray light-sensitive silver halide photographic material capable of obtaining images with a high sensitivity and high sharpness by changing combination of the front and back intensifying screens used on both sides of film, and an image forming method therefor. Other objects will become apparent from the following description.

These objects can be achieved by the following light-sensitive silver halide photographic material and the following image forming method making use of it.

The light-sensitive silver halide photographic material of the present invention comprises a transparent support having a front and back sede and provided on each side thereof a light-sensitive silver halide emulsion layer. The emulsion layer are characterized by the following.

(1) The emulsion layers have different maximum density from each other;

(2) the light-sensitive silver halide photographic material has on its back side the emulsion layer with a lower maximum density, having a density higher than the fog (or minimum density) by 0.20 (density of fog+0.20) or less when exposed from the side of the emulsion layer with a higher maximum density in an amount of exposure that gives it a density higher than the fog density by 1.0 (density of fog+1.0);

(3) the sensitivity of the emulsion layer (the front side) with a higher maximum density is higher than that of the emulsion layer (the back side) with a lower maximum density; and (4) the contrast or a slope linearly connecting two points corresponding to a density higher than the fog by 0.8 (density+0.8) and a density higher than the fog by 1.3 (density of fog+1.3) on the characteristic curve of the higher-sensitive emulsion layer (the front side) is higher than that linearly connecting two points corresponding to a density higher than the fog by 0.3 (density of fog+0.3) and a density higher than the fog by 0.5 (density of fog+0.5) on the characteristic curve of the lower-sensitive emulsion layer.

DETAILED DESCRIPTION OF THE INVENTION

In the method of the present invention, characteristics in double-sided photographing (photographing using two sheets of intensifying screen)can be obtained even when single-sided photographing (photographing using one sheet of intensifying screen) is carried out using a single type of film. For this purpose, an amount of light transmitting through the side of an emulsion layer with a higher maximum density and reaching the interface between an emulsion layer with a lower maximum density and the support (=SL'/SL) may preferably be from 12% to 50%, and particularly preferably from 12% to 30%, wherein the emulsion layer has a sensitivity SL and a reduced apparent sensitivity SL' when exposed from the side with a higher maximum density.

When exclusively used for the single-sided photographing, it is more advantageous for this transmittance to be greater. If, on the other hand, the amount of transmitted light is more than 30% in the case of double-sided photographing, undesirable results may be brought about such that sharpness is remarkably deteriorated because of an increase in cross-over light to cause a lowering of image quality and the characteristics of the intensifying screen used on each side can not be faithfully obtained. Hence, in order to achieve a high image quality and any desired characteristics in either case of single-sided photographing and double-sided photographing using one sheet of film as aimed in the present invention, both the amount of light transmitting through the side with a higher maximum density and reaching the interface between the side with a lower maximum density and the support and the amount of light transmitting through the side with a lower maximum density and reaching the interface between the side with a higher maximum density and the support should preferably be not more than 50%, and particularly preferably be not more than 30%.

In the case when exposed only from the high-sensitivity side using one sheet of fluorescent intensifying screen, the image forming efficiency on the lower-sensitivity side may become very poor if the amount of light transmitting from the higher-sensitivity side to the lower-sensitivity side is less than 12%. In the case of films exclusively used in the photographing using fluorescent intensifying screens on both sides, it is better for the amount of transmitted light to be less than 12%. However, the amount of transmitted light may preferably be not less than 12% and not more than 30% in order to make a film adaptable to both the photographing using one sheet of fluorescent intensifying screen as in the present invention and the photographing using two sheets of fluorescent intensifying screens as in the conventional cases.

When photographing is carried out using a fluorescent intensifying screen brought into close contact only with the high-sensitivity side, the light-sensitive material of the present invention may preferably be capable of obtaining the same gradation as in a conventional double-sided system in which, for example, a film SRG and an intensifying screen SRO-250 (both available from Konica Corporation) are combined. More specifically, the light-sensitive material may preferably be such that, as gamma in the characteristic curve, the slope of the straight line that connects (fog+density 0.25) and (fog+density 2.0) is 1.6 to 3.0.

In this case, photographing may be carried out using a fluorescent intensifying screen brought into close contact only with the high-sensitivity side, whereby gradation and latitude on normal levels can be obtained, and hence can be applied to many purposes. Such a gradation allows to use, in combination, fluorescent intensifying screens with various sensitivities on both sides, so that various sensitivities and gradations can be produced in accordance with photographing purposes.

According to the present invention, the amount of X-rays necessary for obtaining the same image can be made smaller than in the conventional double-sided photographing system, and also a high image quality can be achieved.

A high-sensitivity (high emission intensity) intensifying screen may be used on the high-sensitivity side of the light-sensitive material according to the present invention and a low-sensitivity (low emission intensity) intensifying screen may be used on the low-sensitivity side, whereby gradation can be made higher, the same high contrast as that of, for example, SRH (a film available from Konica Corporation) can be obtained, and a gradation comparable to that of the double-sided system (combination of a film SRH and an intensifying screen SRO-250) can be obtained.

Alternatively, a low-sensitivity (low emission intensity) intensifying screen may be used on the high-sensitivity side of the light-sensitive material according to the present invention and a high-sensitivity (high emission intensity) intensifying screen may be used on the low-sensitivity side, whereby gradation and latitude on normal levels can be obtained which are substantially the same as in the photographing carrying out using a fluorescent intensifying screen brought into close contact with only the high-sensitivity side. In this case also, there is the advantage that the amount of X-rays necessary for obtaining the same image can be smaller.

In the present invention, the photographing carrying out using a fluorescent intensifying screen brought into close contact with only the high-sensitivity side is advantageous in that a very high sharpness can be achieved as compared to the conventional double-sided system. Because of a slightly poor graininess, however, this photographing is limited to the purpose such that bones are photographed at a low tube voltage or contrast photographing is carried out.

As a fundamental method, use of fluorescent intensifying screens on both sides of the light-sensitive material of the present invention has been found to cause a slight decrease in sharpness but instead bring about an improvement in graininess, enabling expansion of purpose to the photographing of the chest.

The emulsion used in the light-sensitive silver halide photographic material of the present invention may be comprised of any silver halide such as silver iodobromide, silver iodochloride or silver iodochlorobromide. It may preferably be comprised of silver iodobromide in view of the advantage that a lightsensitive material with a particularly high speed can be obtained.

Silver halide grains contained in the photographic emulsion may be any of those having grown in an entirely isotropic form such as cubes, octahedrons or tetradecahedrons, those of a polyhedral crystal form such as spheres., those comprised of twinned crystals having a plane defect, or those having a mixed or composite form of any of these. These silver halide grains may have a grain size of from as small as 0.1 μm or less to as large as 20 μm.

The emulsions used in the light-sensitive silver halide photographic material of the present invention can be prepared by known methods. For example, they can be prepared by the methods disclosed in Emulsion Preparation and Types, Research Disclosure (RD) No. 17643, December 1978, pp.22–23, and in RD No. 18716, November 1979, p.648.

The emulsions used in the light-sensitive silver halide photographic material according to the present invention can be prepared by, for example, the method disclosed in T. H. James, "The Theory of the Photographic Process", Fourth Edition, published by Macmillan Publishing Co., Inc. (1977), pages 38–104, and the methods disclosed in G. F. Dauffin, "Photographic Emulsion Chemistry", published by Focal Press Co. (1966), P. Glafkides, "Chemie et Physiquephotographique", published by Paul Montel Co. (1967), and V. L. Zelikman et al, "Making and Coating Photographic Emulsion", published by Focal Press (1964), etc.

More specifically, the emulsions can be prepared by selecting solution conditions of the neutral method, the acid method, the ammonia method, etc., mixing conditions of normal precipitation, reverse precipitation, double-jet precipitation, controlled double-jet precipitation, etc. and grain preparation conditions of the conversion method, the core/shell method, etc., and using any combination of these.

As a preferred embodiment of the present invention, the emulsion is a monodispersed grain emulsion comprising silver iodide localized in the inside of a grain.

The silver halide emulsions preferably used in the present invention may be comprised of internally iodiderich monodisperse grains as disclosed, for example, in Japanese Patent O.P.I. Publications No. 177535/1984, No. 116347/1986, No. 132943/1986 and No. 49751/1988 and Japanese Patent Application No. 238225/1988. They may have a crystal form such as a cube, a tetradecahedron, an octahedron, and intermediate forms thereof, those having (1.1.1) face and (1.0.0) face, any of which may be present as a mixed form.

The monodisperse emulsion herein mentioned is defined in Japanese Patent O.P.I. Publication No. 162244/1985, and refers to an emulsion in which the coefficient of variation of grain size distribution is not more than 0.20.

As to the crystal structure of the silver halide, the grain may have silver halide composition different in its inside and outside. An emulsion as a preferred embodiment is core/shell type monodispersed emulsion grains with a double-layer structure comprised of a core having a high iodide concentration and a shell having a low iodide concentration.

The core having a high iodide concentration may preferably have a silver iodide content of 20 mol % to 40 mol %, and particularly preferably 20 mol % to 30 mol %.

Such a monodisperse emulsion can be prepared by known methods, which are disclosed, for example, in J. Phot. Sic. 12. pp.242-251, Japanese Patent O.P.I. Publications No. 36890/1973, No. 16364/1977, No. 142329/1980 and No. 49938/1983, British Patent No. 1,413,748, and U.S. Pat. Nos. 3,574,628 and No. 3,655,394.

The above monodisperse emulsion may particularly preferably be an emulsion wherein grains have been grown by using seed crystals and feeding silver ions and halide ions while this seed crystals are made to serve as growth nuclei. The core/shell emulsion can be obtained by the methods disclosed in detail, for example, in British Patent No. 1,027,146, U.S. Pat. Nos. 3,505,068 and No. 4,444,877, and Japanese Patent O.P.I. Publication No. 14331/1985.

As another form of the grain, used in the present invention, the silver halide emulsion may be comprised of tabular grains having an average aspect ratio of not less than 3.

Such tabular grains are advantageous in that the efficiency of spectral sensitization can be improved and the graininess and sharpness of an image can be improved. They are disclosed, for example, in British Patent No. 2,112,157, U.S. Pat. Nos. 4,439,520, No. 4,433,048, No. 4,414,310 and No. 4,434,226, and Japanese Patent O.P.I. Publications No. 113927/1983, 127921/1983, No. 138342/1988, No. 284272/1988 and No. 305343/1988. The emulsion can be prepared by the methods disclosed in these publications.

The emulsion described above may be any emulsions of a surface latent image type in which a latent image is formed on the surfaces of grains, an internal latent image type in which a latent image is formed in the insides of grains, or a type in which a latent image is formed on the surfaces and insides. In these emulsions, a cadmium salt, a lead salt, a zinc salt, a thallium salt, an iridium salt or a complex salt thereof, a rhodium salt or a complex salt thereof, an iron salt or a complex salt thereof, or 16 the like may be used at the stage where physical ripening is carried out or grains are prepared. In order to remove soluble salts, the emulsions may be subjected to washing such as noodle washing, flocculation sedimentation or ultrafiltration. Preferred methods of washing are exemplified by a method making use of an aromatic hydrocarbon aldehyde resin as disclosed in Japanese Patent Examined Publication No. 16086/1960 and a method making use of a high-molecular flocculating agent such as exemplary agent G3 or G8, as disclosed in Japanese Patent O.P.I. Publication No. 158644/1988, which are particularly preferred desalting methods.

In the emulsion according to the present invention, various photographic additives can be used in the step anterior or posterior to physical ripening or chemical ripening. Known additives may include the compounds as disclosed in, for example, Research Disclosures (RD) No. 17643 (December, 1978), No. 18716 (November, 1979) and No. 308119 (December, 1989). Kinds of the compounds disclosed in these three Research Disclosures and the paragraphs or columns in which they are described are shown in the following table.

| | RD-17643 | | RD-18716 | | RD-308119 | |
|---|---|---|---|---|---|---|
| Additives | Page | Par. | Page | Column | Page | Par. |
| Chemical sensitizer: | 23 | III | 648 | right, upper | 996 | III |
| Spectral sensitizer: | 23 | IV | 648–649 | | 996–998 | IV |
| Desensitizing dye: | 23 | IV | | | 998 | B |
| Dye: | 25–26 | VIII | 649–650 | | 1003 | VIII |
| Development accelerator: | 29 | XXI | 648 | right, upper | | |
| Antifoggant, Stabilizer: | 24 | IV | 649 | right, upper | 1006–1007 | VI |
| Brightener: | 24 | V | | | 998 | V |
| Hardening agent: | 26 | X | 651 | left | 1005 | X |
| Surface active agent: | 26–27 | XI | 650 | right | 1005–1006 | XI |
| Antistatic agent: | 27 | VII | 650 | right | 1006–1007 | XIII |
| Plasticizer: | 27 | XII | 650 | right | 1006 | XII |
| Lubricant: | 27 | XII | | | | |
| Matting agent: | 28 | XVI | 650 | right | 1008–1009 | XVI |
| Binder: | 26 | XXII | | | 1003–1004 | XXII |
| Support: | 28 | XVII | | | 1009 | XVII |

The support that can be used in the light-sensitive material according to the present invention may include, for example, the supports as described in RD-17643, page 28, and RD-308119, page 1009.

Suitable supports may include plastic films. The surfaces of these supports may commonly be provided with a subbing layer or subjected to corona discharging or ultraviolet irradiation so that the adhesion of coating layers can be improved.

Photographic characteristics of the present invention concern a relation between a higher-sensitive layer on one side and a lower-sensitive layer on another side, which holds irrespective of types of developer or development conditions.

Therefore, the light-sensitive material of the present invention can be developed by the use of conventional developers such as described in the preceding Research Disclosures.

As one of preferred examples, development is carried out at 35° C. for 15 seconds using P-Q type developing solution as shown below.

| Developing solution: | |
|---|---|
| Potassium sulfite | 60.0 g |
| Hydroquinone | 25.0 g |
| 1-Phenyl-3-pyrazolidone | 1.5 g |
| Boric acid | 10.0 g |
| Potassium hydroxide | 23.0 g |
| Triethylene glycol | 17.5 g |
| 5-Methylbenzimidazole | 0.04 g |
| 5-Nitrobenzimidazole | 0.11 g |
| 1-Phenyl-5-mercaptotetrazole | 0.015 g |
| Glacial acetic acid | 16.0 g |
| Potassium bromide | 4.0 g |
| Made up to 1 liter by adding water. | |

EXAMPLES

Examples of the present invention will be given below.

Preparation of silver halide emulsion

Silver halide grains (A) were comprised of 1.3 mol % of iodide and 98.7 mol % of bromide, had an average grain diameter of 2.0 μm and an average grain thickness of 0.4 μm, and had a distribution of grain size of 0.20 as a coefficient of variation.

Grains (B) were comprised of 0.3 mol % of iodide and 98.7 mol % of bromide, had an average grain diameter of 1.7 μm and an average grain thickness of 0.34 μm, and had a distribution of grain size of 0.21 as a coefficient of variation.

In both the resulting grains (A) and (B), 90% or more of the whole projection areas were held by tabular grains.

(Coefficient of variation: according to the method described in Japanese Patent O.P.I. Publication No. 162244/1985)

Preparation of Samples, Processing, and Evaluation

To the silver halide emulsions respectively corresponding to the grains (A) and (B) thus obtained, pure water was added so as to give a volume of 500 ml per mol of silver, and thereafter the mixture was maintained at 50° C. Then, spectral sensitizers DA and DB set out later were added in a weight ratio of 100:1 so as to give their total weight of 600 mg for emulsion (A) and 250 mg for emulsion (B), per mol of silver halide.

After 10 minutes, ammonium thiocyanate was added in an amount of $4\times10^{-3}$ mol for the emulsion (A) and $2\times10^{-3}$ mol for (B), per mol of silver, and chloroauric acid and hypo were further added in appropriate amounts to initiate chemical ripening.

This chemical ripening was carried out under conditions of a pH of 6.15 and a silver potential of 80 mV.

At 15 minutes before completion of the chemical ripening (i.e. 70 minutes after initiation of the chemical ripening), potassium iodide was added in an amount of 300 mg per mol of silver. After 5 minutes, 10% (wt/vol) of acetic acid was added to lower the pH to 5.6, and this pH value was maintained for 5 minutes. Thereafter, an aqueous 0.5% (wt/vol) potassium hydroxide solution was added to restore the pH to 6.15, followed by addition of 2,500 mg of 4-hydroxy-6-methyl-1,3,3a,7-tetrazaindene. The chemical ripening was thus completed.

To the resulting emulsions (A) and (B), the emulsion additives as set out later were added. Photographic emulsion coating solutions were thus prepared.

These photographic emulsion coating solutions were so prepared that they had a pH of 6.20 and a silver potential of 80 mV (35° C.) after their preparation, using sodium carbonate and potassium bromide.

Using these emulsion coating solutions, samples were prepared in the following way: Using two sets of slide hopper type coaters, a support was coated thereon with the emulsion coating solution and the protective layer coating solution set out later, by both-side simultaneous coating at a coating speed of 86 m per minute. The photographic emulsion layers were so formed as to have a gelatin weight of 2.1 g/m on both the high-speed emulsion side and the low-speed emulsion layer side, and have a silver halide weight as shown in Table 1 as a value in terms of silver.

A coating solution for a protective layer was also prepared using the additives as set out later, so as to have a gelatin coating weight of 1.15 m/g$^2$, followed by drying in 2 minutes and 20 seconds. The samples were thus obtained, as shown in Table 1. As the support, a 175 μm thick polyethylene terephthalate film base used for X-ray films and tinted in blue with a density of 0.15 was used, which had been coated with a subbing solution comprising a water-based copolymer dispersion obtained by diluting to a concentration of 10% by weight a copolymer comprising three kinds of monomers of 50% by weight of glycidyl dimethacrylate, 10% by weight of methyl acrylate and 40% by weight of butyl methacrylate.

The spectral sensitizers used in the preparation of samples are as follows: Spectral sensitizer DA Anhydrous 5,5'-dichloro-9-ethyl-3,3-di-(3-sulfopropyl)oxacarbocyanin sodium salt Anhydrous 5,5'-di-(butoxycarbonyl)-1,1'-diethyl-3,3'-di-(4-sulfobutyl)benzoimidazolocarbocyanin sodium salt The additives used in the emulsions (light-sensitive silver halide coating solutions) are as follows. The amounts of the additives are each indicated as weight per mol of silver halide.

| | |
|---|---|
| 1,1-Dimethylol-1-bromo-1-nitromethane | 70 mg |
| t-Butylcatechol | 400 mg |
| Polyvinylpyrrolidone (molecular weight: 10,000) | 1.0 g |
| Styrene/maleic anhydride copolymer | 2.5 g |
| Nitrophenyl-triphenylphosphonium chloride | 50 mg |
| 2-Anilino-4.6-dimercaptotriazine | 60 mg |
| Ammonium 1,3-dihydroxybenzene-4-sulfonate | 4 g |
| Sodium 2-mercaptobenzimidazole-5-sulfonate | 1.5 mg |
| $C_4H_9OCH_2CH(OH)CH_2N(CH_2COOH)_2$ | 1 g |
| 1-Phenyl-5-mercaptotetrazole | 15 mg |
| 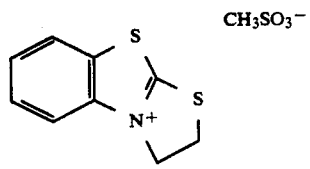 $CH_3SO_3^-$ | 70 mg |

-continued

| | |
|---|---|
| 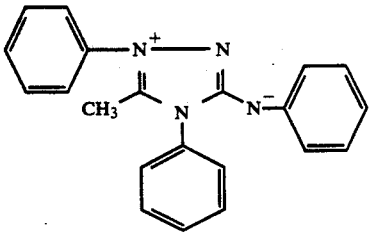 | 150 mg |
| Dye-emulsified dispersion* | 1.2 g |

The additives used in the protective layer coating solution are as follows. The amounts of the additives are each indicated as weight per liter of coating solution.

| | |
|---|---|
| Lime-treated inert gelatin | 68 g |
| Acid-treated gelatin | 2 g |
| Sodium-i-amyl-n-decylsulfosuccinate | 0.3 g |
| Polymethyl methacrylate (a matting agent with an area average particle diameter of 3.5 μm) | 1.1 g |
| Silicon dioxide particles (a matting agent with an area average particle diameter of 1.2 μm) | 0.5 g |
| LUDOX AM (available from Du Pont Co.) (colloidal silica) | 30 g |
| Aqueous 2% solution of sodium 2,4-dichloro-6-hydroxy-1,3,5triazine (a hardening agent) | 10 ml |
| Aqueous 40% glyoxal solution (a hardening agent) | 1.5 ml |
| $(CH_2{=}CHSO_2CH_2)_2O$ (a hardening agent) | 500 mg |
| 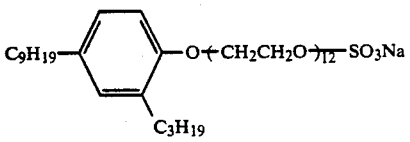 | 1.0 g |
| 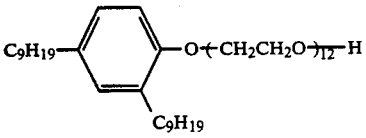 | 0.4 g |
| 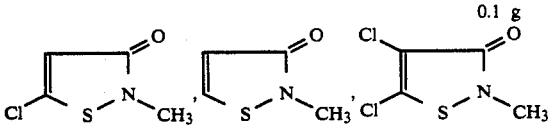 (50:46:4) | 0.1 g |
| $NaO_3S{-}CHCOOCH_2(C_2F_4)_3H$ \| $CH_2COOCH_2(C_2F_4)_3H$ | 0.5 g |
| $C_{12}H_{25}CONH(CH_2CH_2O)_5H$ | 2.0 g |

*The dye-emulsified dispersion was prepared in the following way.

The following dye was weighed in an amount of 10 kg, and was added at 55° C. to a solvent comprised of 28 lit. of tricresyl phosphate and 85 lit. of ethyl acetate. The resulting solution is called an oil-based solution. Meanwhile, 27 l of aqueous 9.3 % gelatin solution in which 1.35 kg of anionic surface active agent (the following AS) was dissolved at 45° C. was prepared. This solution is called a water-based solution.

The above oil-based solution and water-based solution were put in a dispersion vessel, and were dispersed while controlling the liquid temperature to be kept at 40° C.

To the resulting dispersion, 8 g of the following additive C, 16 l of aqueous 2.5% phenol solution and water were added to make up the dispersion to 240 kg, followed by cooling to set to gel.

Dye:

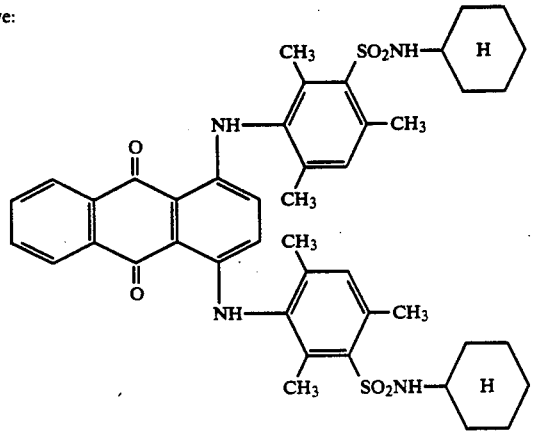

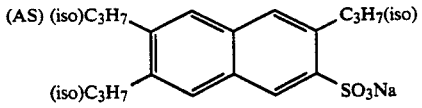

(C) 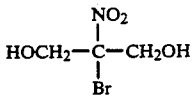

The dispersion thus obtained had an area average particle diameter within the range of from 0.12 to 0.14 μm.

In the measurement of the sensitivity of film No. I thus obtained, photographs were taken by the single-back method (a method in which the intensifying screen was used only on one side) making use of a back screen of fluorescent intensifying screen SRO-250 (available from Konica Corporation). Those on which photographs were taken either using the fluorescent intensifying screen brought into contact with the high-speed emulsion side (side-H) or using the fluorescent intensifying screen brought into contact with the low-speed emulsion side (side-L) were both photographically processed to give samples I-H and I-L, respectively.

In this photographing, a black coating with a high light absorption was applied on the side of the cassette on which no intensifying screen was present.

The photographs were taken under irradiation of X-rays at a tube voltage of 60 kVP at 20 mA for 0.05 second. A sensitometric curve was prepared by the range method, and the sensitivity, maximum density and gamma of each sample were obtained.

The photographic processing was carried out using an automatic processor SRX-502, manufactured by Konica Corporation, and using a P-Q type developing solution and a fixing solution each composed as shown below. The processing was carried out at a developing bath temperature of 35° C. for about 15 seconds and a fixing bath temperature of 33° C. for about 10 seconds. Washing water was kept at 18° C. and fed at a rate of 4 lit. for about 10 seconds, followed by drying for about 10 seconds per minute. The whole processing was carried out in the processing mode of 45 seconds.

The light-sensitive layer on the side-L was removed from the sample I-H by the use of a protein-lytic enzyme to determine the sensitivity of side-H. Similarly the light-sensitive layer on the side-H was removed from the sample I-L to determine the sensitivity of side-L.

The value of sensitivity was determined as a reciprocal of the amount of X-rays that was necessary to obtain a density corresponding to a value obtained by multiplying by 0.4 the value obtained by subtracting the fog (or minimum density) from the maximum density, and further adding thereto the fog density. The value is indicated as a relative sensitivity with respect to the sensitivity of sample No. 1 of Table 2 that is assumed as 100.

Sample No. 1 is a sample having the same emulsion component layers as conventional double-sided X-ray films and to which usual exposure has been applied using fluorescent intensifying screens on its both sides.

The gamma shown in Table 3 is indicated as a reciprocal of a difference between logarithms of reciprocals of the amounts of X-rays that give a density 1.0 and a density 2.0.

To evaluate the image quality of each sample No. 1 to 20, sharpness was evaluated according to the following Funk chart photographing.

Photographs were taken at a tube voltage of 90 kVP using in combination the fluorescent intensifying screens as shown in Table 2, according to the single-back method. Processing was carried out in the same manner as in the sensitometry described above (i.e., processing using the same automatic processor, processing solutions, processing temperature and processing time).

To evaluate the sharpness, using a Funk test chart SMS5853 (trade name; available from Konica Medical Corporation), photographs were taken using the intensifying screen and film in the combination as shown in Table 2, and then processed under the same conditions as describe above.

As to the amount of exposure, each sample was exposed so as to be 0.8±0.02 in average density of the light and shade produced by the Funk test chart.

| Composition of processing solutions | |
|---|---|
| Developing solution (P-Q type): | |
| Potassium sulfite | 60.0 g |
| Hydroquinone | 25.0 g |
| 1-Phenyl-3-pyrazolidone | 1.5 g |
| Boric acid | 10.0 g |
| Potassium hydroxide | 23.0 g |
| Triethylene glycol | 17.5 g |
| 5-Methylbenzimidazole | 0.04 g |
| 5-Nitrobenzimidazole | 0.11 g |
| 1-Phenyl-5-mercaptotetrazole | 0.015 g |
| Glacial acetic acid | 16.0 g |
| Potassium bromide | 4.0 g |
| Made up to 1 liter by adding water. | |
| Fixing solution: | |
| Sodium thiosulfate | 45 g |
| Disodium ethylenediaminetetraacetic acid | 0.5 g |
| Ammonium thiosulfate | 150 g |
| Anhydrous sodium sulfite | 8 g |
| Potassium acetate | 16 g |
| Aluminum sulfate decahydrate | 27 g |

-continued

| Composition of processing solutions | |
|---|---|
| sulfuric acid (50% by weight) | 6 g |
| Citric acid | 7 g |
| Boric acid | 7 g |
| Glacial acetic acid | 3 g |

Made up to 1 liter by adding water and adjusted the pH to 4.6 (25° C.) using glacial acetic acid.

The developing solution and the fixing solution were put in the automatic processor 24 hours after their preparation was completed, and then used.

Evaluation of sharpness was made based on the following criterion.

A: Using a hand magnifier, recognizable up to 10 LP/mm.

B: Using a hand magnifier, recognizable up to 8 LP/mm.

C: Using a hand magnifier, recognizable up to 6 LP/mm.

D: Using a hand magnifier, recognizable up to 5 LP/mm.

E: Using a hand magnifier, recognizable up to 4 LP/mm.

With regard to graininess, photographs were taken under irradiation of X-rays at a tube voltage of 90 kVP, using a penetrometer made of aluminum and having 20-stage thicknesses to each stage of which acrylate beads of 3 mm in diameter and aluminum balls of 3 mm in diameter had been adhered, and then processed under the same processing conditions as the sensitometry previously described. The samples thus obtained were visually evaluated for their graininess at densities of from 0.5 to 1.2 in the range of which the graininess was conspicuous, based on the following criterion.

A: The same as sample No. 1 in Table 3 with a very good graininess.

B: Slightly deteriorated compared with sample No. 1, but without any difficulty in practical use.

C: The same as sample No. 5 making use of high-contrast double sided films, with clearly recognizable deterioration of graininess.

D: Graininess has so seriously deteriorated that the image of acrylate beads, having a slight difference in density, can be recognized with difficulty, but without any influence in recognizing the image of aluminum balls, having a large difference in density.

E: Graininess has so seriously deteriorated that even the image of acrylate beads can be recognized with difficulty, and the product is of no practical use.

In the foregoing, A indicates the best, and E, the worst. Results obtained are shown in Table 3 later.

Particulars and characteristics of the coated films are shown in Table 1.

The fluorescent intensifying screens SRO-125, SRO-250 and SRO-500, available from Konica Corporation, are sold by the front and back screens in pairs. Regarding films No. I and II of Table 1, which had the same characteristics on both sides of the support, front screens were used on the front sides, and back screens on the back sides. Regarding films No. III to VII, which had different characteristics on both sides of the support, back screens were used in all instances.

TABLE 1

| Coated film No. | High-sensitivity emulsion layer configuration (H side) Emulsion | Silver weight ($g/m^2$) | Max. density | Low-sensitivity emulsion layer configuration (L side) Emulsion | Silver weight ($g/m^2$) | Max. density | Transmitted SL'/SL | SH'/SH | R* |
|---|---|---|---|---|---|---|---|---|---|
| I | (B) | 1.9 | 1.73 | (B) | 1.9 | 1.73 | 0.28 | 0.28 | X |
| II | (B) | 2.4 | 2.14 | (B) | 2.4 | 2.14 | 0.23 | 0.23 | X |
| III | (A) | 2.9 | 2.12 | (B) | 1.8 | 1.65 | 0.16 | 0.29 | Y |
| IV | (A) | 2.3 | 1.71 | (B) | 1.9 | 1.73 | 0.20 | 0.28 | X |
| V | (A) | 3.0 | 2.19 | (B) | 1.4 | 1.32 | 0.15 | 0.34 | Y |
| VI | (A) | 3.0 | 2.19 | (B) | 2.0 | 1.82 | 0.15 | 0.27 | Y |
| VII | (A) | 2.0 | 1.51 | (B) | 2.0 | 1.82 | 0.23 | 0.27 | X |

*Remarks
X: Comparative Example
Y: Present Invention

Furthermore, coated films had the following photographic characteristics.

Coated film No. I had the same characteristics in its both emulsion layer sides on the support, and had a relative sensitivity of 68 on each of the H side of a higher speed emulsion layer, and the L side of a lower speed emulsion layer.

Contrast GH connecting density of fog+0.8 and density of fog+1.3 of the characteristic curve of the H side was 1.30; contrast GL connecting density of fog+0.3 and density of fog+0.5 was of the characteristic curve of the L side 1.15; and the density of the L side in the case when the H side was exposed in an amount of exposure that gave a density of fog+1.0 was fog+0.32.

Coated film No. II had also the same characteristics in its both emulsion layer sides on the support, and had a relative sensitivity of 75 in each of the H side and L side.

Contrast GH connecting a density of fog+0.8 and a density of fog+1.3 of the H side was 1.62.

Contrast GL connecting a density of fog+0.3 and a density of fog+0.5 of the L side was 1.45.

The density of the L side in the case when the H side was exposed in an amount of exposure that gave a density of fog+1.0 was fog+0.22.

Coated film No. III had different characteristics in its both emulsion layer sides on the support, and had a relative sensitivity of 98 in the H side and a relative sensitivity of 67 in the L side.

Contrast GH connecting a density of fog+0.8 and a density of fog+1.3 of the H side was 2.30.

Contrast GL connecting a density of fog+0.3 and a density of fog+0.5 of the L side was 1.10.

The density of the L side in the case when the H side was exposed in an amount of exposure that gave a density of fog+1.0 was fog+0.06.

Coated film No. IV had different characteristics in its both emulsion layer sides on the support, and had a relative sensitivity of 91 in the H side and a relative sensitivity of 68 in the L side.

Contrast GH connecting a density of fog+0.8 and a density of fog+1.3 of the H side was 1.80.

Contrast GL connecting a density of fog+0.3 and a density of fog+0.5 of the L side was 1.15.

The density of the L side in the case when the H side was exposed in an amount of exposure that gave a density of fog+1.0 was fog+0.12.

Coated film No. V had different characteristics in its both emulsion layer sides on the support, and had a relative sensitivity of 99 in the H side and a relative sensitivity of 60 in the L side.

Contrast GH connecting a density of fog+0.8 and a density of fog+1.3 of the H side was 2.35.

Contrast GL connecting a density of fog+0.3 and a density of fog+0.5 of the L side was 0.90.

The density of the L side in the case when the H side was exposed in an amount of exposure that gave a density of fog+1.0 was fog+0.05.

Coated film No. VI had different characteristics in its both emulsion layer sides on the support, and had a relative sensitivity of 99 in the H side and a relative sensitivity of 70 in the L side.

Contrast GH connecting a density of fog+0.8 and a density of fog+1.3 of the H side was 2.35.

Contrast GL connecting a density of fog +0.3 and a density of fog+0.5 of the L side was 1.35.

The density of the L side in the case when the H side was exposed in an amount of exposure that gave a density of fog+1.0 was fog +0.05.

Coated film No. VII had different characteristics in its both emulsion layer sides on the support, and had a relative sensitivity of 87 in the H side and a relative sensitivity of 70 in the L side.

Contrast GH connecting a density of fog+0.8 and a density of fog+1.3 of the H side was 1.35.

Contrast GL connecting a density of fog+0.3 and a density of fog+0.5 of the L side was 1.35.

The density of the L side in the case when the H side was exposed in an amount of exposure that gave a density of fog+1.0 was fog+0.05.

Using these films and using fluorescent intensifying screens arranged as shown in the following Table 2, sensitivity and contrast were determined (Table 3).

Determination of system sensitivity and contrast

Exposure of the samples was made using intensifying screens with different sensitivities (emission intensity) on one side or both sides of each sample. Relative sensitivity of each sample was determined as a reciprocal of the amount of X-rays that was necessary for obtaining a density of fog+1.0. Its value is shown as relative sensitivity, assuming as 100 the sensitivity of sample 1. Contrast (gamma) is shown as a difference between logarithms of reciprocals of the amounts of X-rays that give densities 1.0 and 2.0.

Determination of SL', SL, SH' and SH

The sensitivity SL' of the emulsion layer side with a lower maximum density in the case when exposed from the side of the emulsion layer with a high maximum density using a fluorescent intensifying screen and the sensitivity SL of the emulsion layer side with a lower maximum density in the case when exposed from the side of the emulsion layer with a lower maximum density using a fluorescent intensifying screen was measured by removing the emulsion layer with a higher maximum density by the use of a protein-lytic enzyme. The sensitivity SH' of the emulsion layer side with a higher maximum density in the case when exposed from the side of the emulsion layer with a lower maximum density using a fluorescent intensifying screen and the sensitivity SH of the emulsion layer side with a higher maximum density in the case when exposed from the side of the emulsion layer with a high maximum density using a fluorescent intensifying screen was measured by removing the emulsion layer with a low maximum density by the use of a protein-lytic enzyme.

SL', SL, SH' and SH were each obtained as a reciprocal of the amount of X-rays that was necessary to obtain a density corresponding to a value obtained by multiplying by 0.4 the value obtained by subtracting the fog from the maximum density, and further adding thereto the fog density.

Determination of contrast of each side

The samples from which the above SL and SH were determined were used.

With regard to the high-sensitivity side, the contrast was determined as a value obtained by multiplying a difference between logarithms of reciprocals of the amounts of X-rays that gave the density of fog+0.8 and density of fog+1.3 on the characteristic curve by 1/(1.3–0.8). With regard to the low-sensitivity side, the contrast was determined as a value of a difference between logarithms of reciprocals of the amounts of X-rays that gave the density of fog+0.3 and density of fog+0.5 on the characteristic curve times 1/(0.5–0.3).

As for the conventional type films I and II, coated with the same emulsion on their both sides, the contrast was determined by multiplying a difference between logarithms of reciprocals of the amounts of X-rays that gave the density of fog+0.8 and density of fog+1.3 on the characteristic curve by 1/(1.30–0.8).

Results obtained are shown in Tables 2 and 3.

TABLE 2

| Sample No. | Film used | Front emulsion layer side | Back emulsion layer side | Front intensifying screen | Back intensifying screen |
|---|---|---|---|---|---|
| 1 | I | LS* | HS** | SRO-250 | SRO-250 |
| 2 | I | LS | HS | SRO-500 | SRO-500 |
| 3 | I | LS | HS | SRO-125 | SRO-500 |
| 4 | I | LS | HS | None | SRO-250 |
| 5 | II | LS | HS | SRO-250 | SRO-250 |
| 6 | III | LS | HS | None | SRO-250 |
| 7 | III | LS | HS | SRO-150 | SRO-500 |
| 8 | III | LS | HS | SRO-125 | SRO-250 |
| 9 | III | LS | HS | SRO-500 | SRO-125 |
| 10 | III | HS | LS | SRO-125 | SRO-500 |
| 11 | III | HS | LS | None | SRO-250 |
| 12 | III | HS | LS | SRO-250 | None |
| 13 | IV | LS | HS | SRO-125 | SRO-500 |
| 14 | IV | LS | HS | SRO-500 | SRO-125 |
| 15 | V | LS | HS | SRO-125 | SRO-500 |
| 16 | V | LS | HS | SRO-500 | SRO-125 |
| 17 | VI | LS | HS | SRO-125 | SRO-500 |
| 18 | VI | LS | HS | SRO-500 | SRO-125 |
| 19 | VII | LS | HS | SRO-125 | SRO-500 |
| 20 | VII | LS | HS | SRO-500 | SRO-125 |

*LS: Low-sensitivity emulsion layer
**HS: High-sensitivity emulsion layer

TABLE 3

| Sample No. | System sensitivity | System gamma | Visual graininess (Density 0.5–1.2) | Visual sharpness (Funk chart) | Remarks |
|---|---|---|---|---|---|
| 1 | 100 | 2.90 | A | D | X |
| 2 | 200 | 2.90 | C | E | X |
| 3 | 160 | 2.65 | B | E | X |
| 4 | 62 | 2.45 | C | C | X |
| 5 | 110 | 3.50 | C | C | X |
| 6 | 100 | 2.85 | D | A | Y |
| 7 | 210 | 3.70 | C | B | Y |
| 8 | 125 | 4.10 | C | A | Y |
| 9 | 155 | 3.00 | A | C | Y |
| 10 | 160 | 2.95 | A | C | Y |
| 11 | 78 | 4.45 | B | B | Y |
| 12 | 98 | 2.85 | D | A | Y |
| 13 | 200 | 3.50 | C | D | X |
| 14 | 160 | 2.95 | B | D | X |
| 15 | 210 | 3.60 | C | B | Y |
| 16 | 150 | 2.70 | B | C | Y |
| 17 | 210 | 3.85 | C | B | Y |
| 18 | 165 | 3.05 | A | C | Y |
| 19 | 185 | 3.35 | B | D | X |
| 20 | 160 | 2.90 | B | D | X |

As is clear from Tables 2 and 3, the samples according to the present invention have good graininess and sharpness in a well balanced state and are comparable to the samples of the conventional systems in which fluorescent intensifying screens with substantially the same emission intensity (within 40%) are used on films having photographi emulsion layer having the same photographic characteristics on both sides of the support.

Sample No. 6, obtained by photographing the film III of the present invention by the single back method, shows an improvement in sensitivity, graininess and sharpness in a better balance than the comparative examples, the doublesided system samples No. 1, 2, 3 and 5. Moreover, of the samples obtained by taking photographs using in combination a high-sensitivity fluorescent intensifying screen on a lower-sensitivity emulsion layer side and a low-sensitivity fluorescent intensifying screen on a higher-sensitivity emulsion layer side, the sample No. 18 according to the present invention has better graininess and sharpness than the sample No. 14 having a higher maximum density on the lower-sensitivity emulsion layer side than the maximum density on the higher-sensitivity emulsion layer side. Thus, according to the present invention, images with various contrast can be obtained by taking photographs using a single type of film, selecting, according to purpose, fluorescent intensifying screens with different emission intensity. Hence, it has become unnecessary to keep a number of types of films according to portions to be photographed or photographing purposes, it has become easy to manage the stock, and also it has become possible to prevent a mistake of film types when used.

I claim:

1. A light sensitive silver halide photographic material for exposure with a fluorescent image intensifying screen in contact with a first side, a second side or both the first and second sides thereof, the photographic material comprising a support with a first side and a second side corresponding to the first and second sides respectively of said photographic material, and a first and a second emulsion layer carried respectively on said first and second sides of the support, wherein :

said first emulsion layer has a maximum density and a sensitivity higher than the maximum density and sensitivity of said second emulsion layer;

said second emulsion layer has a density of not more than 0.2 above the second emulsion layer fog density when said light-sensitive material is exposed from the first side in an amount that gives said first emulsion layer a density of 1.0 above the first emulsion layer fog density; and a slope of a straight line that connects two points corresponding to densities of 0.8 above the first emulsion layer fog density and 1.3 above the first emulsion layer fog density on a characteristic curve of said first emulsion layer is more than a slope of a straight line that connects two points corresponding to densities of 0.3 above the second emulsion layer fog density and 0.5 above the second emulsion layer fog density on a characteristic curve of said second emulsion layer.

2. The light sensitive material of claim 1, wherein said second emulsion layer has a light sensitivity SL; and a reduced apparent sensitivity SL' when said light sensitive material is exposed from said first side thereof through said first emulsion layer; and wherein the ratio SL'/SL is in a range of from 0.12 to 0.30.

3. The light sensitive material of claim 1, wherein said first emulsion layer has a sensitivity SH; and a reduced apparent sensitivity SH' when said light sensitive material is exposed from said second side thereof through said second emulsion layer; and wherein the ratio SH'/SH is not more than 0.30.

4. The light sensitive material of claim 1, wherein at least one of said first and second emulsion layer comprises monodispersed grains comprising silver iodide localized in the inside of a grain.

5. The light sensitive material of claim 1, wherein at least one of said first and second emulsion layer comprises tabular grains having an aspect ratio of not less than 3.

6. In an image forming method comprising image wise exposing a light sensitive material to X-ray irradiation which has passed through an object of predetermined density to form the image wherein a fluorescent image intensifying screen is used in contact with at least one side of the photographic material and whereafter the light sensitive material is developed to form the visible image, the improvement whereby the effective characteristics of the light sensitive material can be changed, comprising using the light sensitive material of claim 1 as the photographic material.

7. The image forming method of claim 6, wherein one fluorescent screen is used and said fluorescent screen is in contact with the first side of the light sensitive material side, whereby contrast and latitude of normal levels is obtained and the method can be applied to general uses.

8. The image forming method of claim 6, wherein two fluorescent screens are used, a first said fluorescent screen with higher emission intensity placed in contact with the first side of said light sensitive material, and a second said fluorescent screen with lower emission placed in contact with the second side of said light sensitive material, whereby a higher-contrast image is obtained.

9. The image forming method of claim 6, wherein two fluorescent screens are used, a first said fluorescent screen with higher emission is placed in contact with the second side of said light sensitive material, and a second said fluorescent screen with lower emission is placed in contact with the first side of said light sensitive photographic material, whereby contrast and latitude of normal levels is obtained and the method can be applied to general uses.

10. The light sensitive material of claim 1, wherein fog density is a minimum value of the density measured on the photographic material after development processing, and densities and the characteristic curve are determined by measuring the density of the photographic material after development processing in an automatic processor set for 45 seconds processing including developing with a P-Q developer at a temperature of about 35° C. followed by a fixing bath at about 33° C. and washing.

* * * * *